US007015786B2

(12) United States Patent
Ramarge et al.

(10) Patent No.: US 7,015,786 B2
(45) **Date of Patent: *Mar. 21, 2006**

(54) MECHANICAL REINFORCEMENT TO IMPROVE HIGH CURRENT, SHORT DURATION WITHSTAND OF A MONOLITHIC DISK OR BONDED DISK STACK

(75) Inventors: Michael M. Ramarge, Olean, NY (US); Thomas C. Hartman, Spring Hill, FL (US)

(73) Assignee: McGraw-Edison Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/940,539

(22) Filed: Aug. 29, 2001

(65) Prior Publication Data

US 2003/0043526 A1 Mar. 6, 2003

(51) Int. Cl.
*H01C 7/10* (2006.01)

(52) U.S. Cl. ..... 338/20; 338/21; 361/127

(58) Field of Classification Search ..... 338/20, 338/21; 311/127; 29/830, 825, 840, 846
See application file for complete search history.

(56) References Cited

U.S. PATENT DOCUMENTS

| | | | | |
|---|---|---|---|---|
| 3,913,127 | A | | 10/1975 | Suzuki et al. |
| 4,404,614 | A | | 9/1983 | Koch et al. |
| 4,656,555 | A | | 4/1987 | Raudabaugh |
| 4,851,955 | A | | 7/1989 | Doone et al. |
| 4,899,248 | A | | 2/1990 | Raudabaugh |
| 4,962,440 | A | | 10/1990 | Johnnerfelt et al. |
| 4,992,906 | A | | 2/1991 | Doone et al. |
| 5,003,689 | A | * | 4/1991 | Doone et al. ..... 29/613 |
| 5,043,838 | A | | 8/1991 | Sakich |
| 5,047,891 | A | * | 9/1991 | Nedriga ..... 361/117 |
| 5,128,824 | A | | 7/1992 | Yaworski et al. |
| 5,159,748 | A | | 11/1992 | Doone et al. |
| 5,218,508 | A | | 6/1993 | Doone |
| 5,225,265 | A | | 7/1993 | Prandy et al. |
| 5,363,266 | A | | 11/1994 | Wiseman et al. |
| 5,497,138 | A | | 3/1996 | Malpiece et al. |
| 5,570,264 | A | | 10/1996 | Lundquist et al. |

(Continued)

FOREIGN PATENT DOCUMENTS

JP 03034522 A * 2/1991

(Continued)

OTHER PUBLICATIONS

Polymer Distribution & Riser Pole Arresters, GE Products (from WEB)(Jan. 13, 200).*

*Primary Examiner*—Karl D. Easthom
(74) *Attorney, Agent, or Firm*—Fish & Richardson P.C.

(57) ABSTRACT

A mechanical reinforcement for an electrical apparatus has at least one electrical element with an outer surface and a reinforcing structure attached to the outer surface. The electrical element may be a monolithic MOV disk or a bonded MOV disk stack. The monolithic element may, for example, have a rating greater than 6 kV. The reinforcing structure may be pre-impregnated fiber matrix that may be, for example, pre-impregnated with resin. The mechanical reinforcement provides improved high current durability to the electrical apparatus.

72 Claims, 13 Drawing Sheets

U.S. PATENT DOCUMENTS 5,602,710 A * 2/1997 Schmidt et al. ..... 361/127
5,608,597 A 3/1997 Holmström et al.
5,912,611 A 6/1999 Berggren et al.
5,926,356 A 7/1999 Sakich et al.
5,936,826 A 8/1999 Schmidt
6,008,975 A * 12/1999 Kester et al. ..... 361/117
6,008,977 A 12/1999 Thatcher
6,185,813 B1 * 2/2001 Donnola ..... 29/613
6,396,676 B1 5/2002 Doone et al.
6,483,685 B1 * 11/2002 Ramarge et al. ..... 361/118

FOREIGN PATENT DOCUMENTS

JP 11340635 A * 12/1995

* cited by examiner

MECHANICAL REINFORCEMENT TO IMPROVE HIGH CURRENT, SHORT DURATION WITHSTAND OF A MONOLITHIC DISK OR BONDED DISK STACK

TECHNICAL FIELD

The invention relates to surge arresters and other types of electrical power distribution equipment, and more particularly to mechanical reinforcement of a monolithic disk or a bonded disk stack used in such equipment.

BACKGROUND

Electrical transmission and distribution equipment is subject to voltages within a fairly narrow range under normal operating conditions. However, system disturbances, such as lightning strikes and switching surges, may produce momentary or extended voltage levels that greatly exceed the levels experienced by the equipment during normal operating conditions. These voltage variations often are referred to as over-voltage conditions.

If not protected from over-voltage conditions, critical and expensive equipment, such as transformers, switching devices, computer equipment, and electrical machinery, may be damaged or destroyed by over-voltage conditions and associated current surges. Accordingly, it is routine practice for system designers to use surge arresters to protect system components from dangerous over-voltage conditions.

A surge arrester is a protective device that commonly is connected in parallel with a comparatively expensive piece of electrical equipment so as to shunt or divert over-voltage-induced current surges safely around the equipment, and thereby protect the equipment and its internal circuitry from damage. When exposed to an over-voltage condition, the surge arrester operates in a low impedance mode that provides a current path to electrical ground having a relatively low impedance. The surge arrester otherwise operates in a high impedance mode that provides a current path to ground having a relatively high impedance. The impedance of the current path is substantially lower than the impedance of the equipment being protected by the surge arrester when the surge arrester is operating in the low-impedance mode, and is otherwise substantially higher than the impedance of the protected equipment.

Upon completion of the over-voltage condition, the surge arrester returns to operation in the high impedance mode. This prevents normal current at the system frequency from following the surge current to ground along the current path through the surge arrester.

Conventional surge arresters typically include an elongated outer enclosure or housing made of an electrically insulating material, a pair of electrical terminals at opposite ends of the enclosure for connecting the arrester between a line-potential conductor and electrical ground, and one or more other electrical components that form a series electrical path between the terminals. These components typically include a stack of one or more voltage-dependent, nonlinear resistive elements that are referred to as varistors. A varistor is characterized by having a relatively high resistance when exposed to a normal operating voltage, and a much lower resistance when exposed to a larger voltage, such as is associated with over-voltage conditions. In addition to or in place of varistors, a surge arrester also may include one or more spark gap assemblies housed within the insulative enclosure and electrically connected in series with the varistors. Some arresters also include one or more electrically-conductive spacer elements coaxially aligned with the varistors and gap assemblies.

For proper arrester operation, contact must be maintained between the components of the stack. To accomplish this, it is known to apply an axial load to the one or more elements of the stack. Good axial contact is important to ensure a relatively low contact resistance between the adjacent faces of the elements, to ensure a relatively uniform current distribution through the elements, and to provide good heat transfer between the elements and the end terminals.

One way to apply this load is to employ springs within the housing to urge the one or more stacked elements into engagement with one another. Another way to apply the load is to encase the stack of one or more arrester elements in glass fibers so as to axially-compress the elements within the stack. For bonded disk stacks or monolithic disks with a sufficiently high rating, such as, for example, a rating greater than 6 kV, these methods are usually sufficient to sustain a static mechanical load but may not be sufficient to withstand the thermo-mechanical forces experienced by the one or more elements during a high current impulse such as, for example, a 100 kA impulse.

When the bonded disk stack or monolithic disk with a sufficiently high rating, such as, for example, a rating greater than 6 kV, is subjected to a high current impulse, the resulting thermo-mechanical forces tend to cause cracking of the surge arrester elements, which tend to crack in mid-plane when subjected to the thermo-mechanical forces of a high current impulse. For bonded disk stacks of more than one element, there also may be cracking near the center of the bonded disk column or the monolithic element. The tendency of an element to crack during high current impulses limits the size of an individual surge arrester element as well as the overall length of a stack of bonded surge arrester elements. There is a height-diameter ratio where a monolithic disk or a bonded disk stack will be subject to thermo-mechanical failure due to a high current impulse, typically in the form of a crack at the mid-plane.

SUMMARY

In one general aspect, a mechanically reinforced electrical apparatus includes at least one electrical element having a reinforcing structure attached to the outer surface of the electrical element. The reinforcing structure may include a fiber matrix pre-impregnated with a resin. The fiber matrix may be any woven or interwoven fabric, sheet, tape, or strip. The fiber matrix may encompass any form factor, and may be narrow or wide as needed to selectively reinforce the bonded disk stack or monolithic element. The fiber matrix typically has a pre-formed woven or interwoven pattern. However, the fiber matrix also may take other forms, such as the form of a collection of fiber segments. The fiber matrix is pre-impregnated with resin, and is applied to the electrical elements as desired.

Implementations may include one or more of the following features. For example, the electrical element may be a monolithic metal-oxide varistor ("MOV") disk or a bonded MOV disk stack. Each end of the monolithic disk is in contact with a terminal accessible from the exterior of the apparatus. Monolithic disks may be rated, for example, greater than 6 kV and, more particularly, between 6 kV and 800 kV. The electrical apparatus may be built to withstand at least one approximately 100 kA impulse. The fibers in the fiber matrix may be oriented in a predetermined orientation, oriented parallel to an axis of the electrical element, or oriented in a random direction. The fibers in the fiber matrix may be of a predetermined length, a uniform length, and/or of more than one length. The fibers in the fiber matrix may be any insulated fibrous material such as, for example, fiberglass, Kevlar, Nextel, or a similar material.

In one implementation, the fiber matrix is made with a predetermined woven or interwoven pattern such that, when applied to the electrical element, the fibers are at a predetermined angle. For example, the pattern may be a back and forth wind pattern, or any other woven or interwoven pattern. The predetermined angle may be an angle less than approximately 50 degrees, such as, for example, an angle between approximately 3 degrees and approximately 10 degrees. The fiber matrix may be circumferentially applied to the electrical element. The fiber matrix may be applied to the electrical element in layers to a predetermined thickness, such as, for example, approximately up to one-quarter of an inch, and more typically approximately twenty thousandths of an inch. The fiber matrix may also be vertically applied or may be combined with, for example, a vertically applied matrix and/or fiber segments embedded in resin.

In another implementation, the pre-impregnated fiber matrix is vertically (i.e., longitudinally) applied. In one implementation, the vertical application may have at least one piece of matrix that may be vertically oriented along an axis of the electrical element. The vertical application may also have a single piece of matrix placed in a vertical orientation along an axis of the electrical element with sufficient width to cover the majority of an outer surface of the electrical element. The vertical application may have a predetermined thickness. The fiber matrix may also be circumferentially applied or may be combined with, for example, a circumferentially applied matrix and/or fiber segments embedded in resin.

In another implementation, the reinforcing structure may have at least one layer of pre-impregnated fiber matrix applied circumferentially with fibers oriented at a predetermined angle and at least one layer of pre-impregnated fiber matrix applied vertically. In another implementation, the reinforcing structure may have a coating of fiber segments embedded in a resin.

In another general aspect, reinforcing an electrical apparatus includes providing at least one electrical element, preparing a reinforcing layer for application to the outer surface of at least one electrical element, and applying the reinforcing layer to at least a portion of the outer surface of at least one electrical element. The reinforcing layer has a fiber matrix pre-impregnated with resin.

Implementations may include one or more of the features discussed above and one or more of the following features. For example, the element may be heated to a sufficient temperature for application of the fiber matrix, such as, for example, to between approximately 100 degrees and 200 degrees Fahrenheit. In another implementation, post application processing of the reinforcing layer may be performed. The post application processing may include curing or heating the element. The heating may be done in an oven, by a forced air gun, or by other suitable method. The element may be heated to a sufficient temperature for curing. For example, the element may be heated to between approximately 250 degrees and 400 degrees Fahrenheit.

In another general aspect, reinforcing an electrical apparatus includes providing at least one electrical element, preparing a reinforcing layer for application to the outer surface of at least one electrical element, and applying the reinforcing layer to at least a portion of the outer surface of at least one electrical element. The reinforcing layer has a mixture of fibers pre-impregnated with resin.

Implementations may include one or more of the features of discussed above and one or more of the following features. For example, the reinforcing layer may be applied by coating the element by dipping the element in a mixture of fibers and resin, casting the element in a pre-impregnated fiber matrix, powder coating the element in a fiber matrix, coating the element in a fiber matrix, or other suitable techniques.

The mechanically-reinforced electrical apparatus, which may be, for example, a surge arrester, offers considerable advantages. For example, the mechanical reinforcement restricts the tendency of a bonded stack of elements or a monolithic element to crack during a high current impulse. In this manner, the length or thickness of the monolithic element or the bonded stack can be increased without a subsequent increase in the risk of cracking during an impulse. The element or the bonded stack also can be left at a conventional length and have a decreased likelihood that the element or the bonded stack will crack as compared to a non-reinforced monolithic element or bonded stack of the same dimensions. To minimize the cost of reinforcement, the reinforcing structure can be placed only in those areas where the crack is likely to occur, typically in the area around and including the center of the element or the bonded stack along its length. As a result, increased-length monolithic elements can be produced that are longer than those currently used in surge arresters. Also, the use of bonded disk stacks becomes practical. This use promises to increase the applicability of monolithic elements, such as MOVs to bonded disk stack surge arresters as well as to monolithic surge arresters.

Other features and advantages will be apparent from the description, the drawings, and the claims.

DESCRIPTION OF DRAWINGS

Like reference symbols in the various drawings indicate like elements.

DETAILED DESCRIPTION

Figure 1:
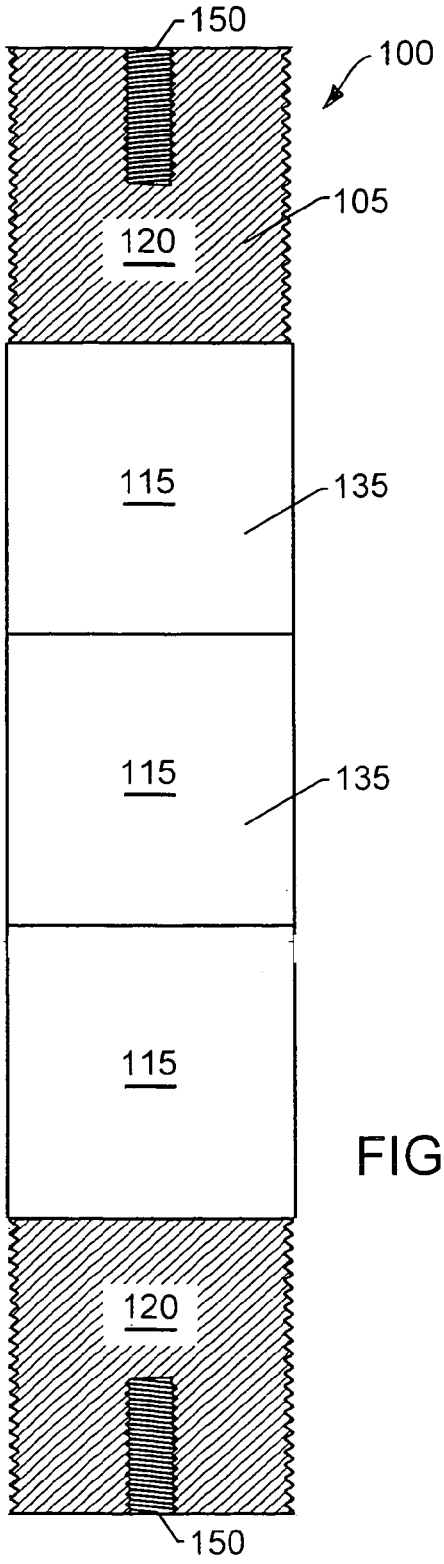
FIG. 1 is a cross-sectional view of a bonded electrical component module showing joints between adjacent electrical components.
Figure 2:
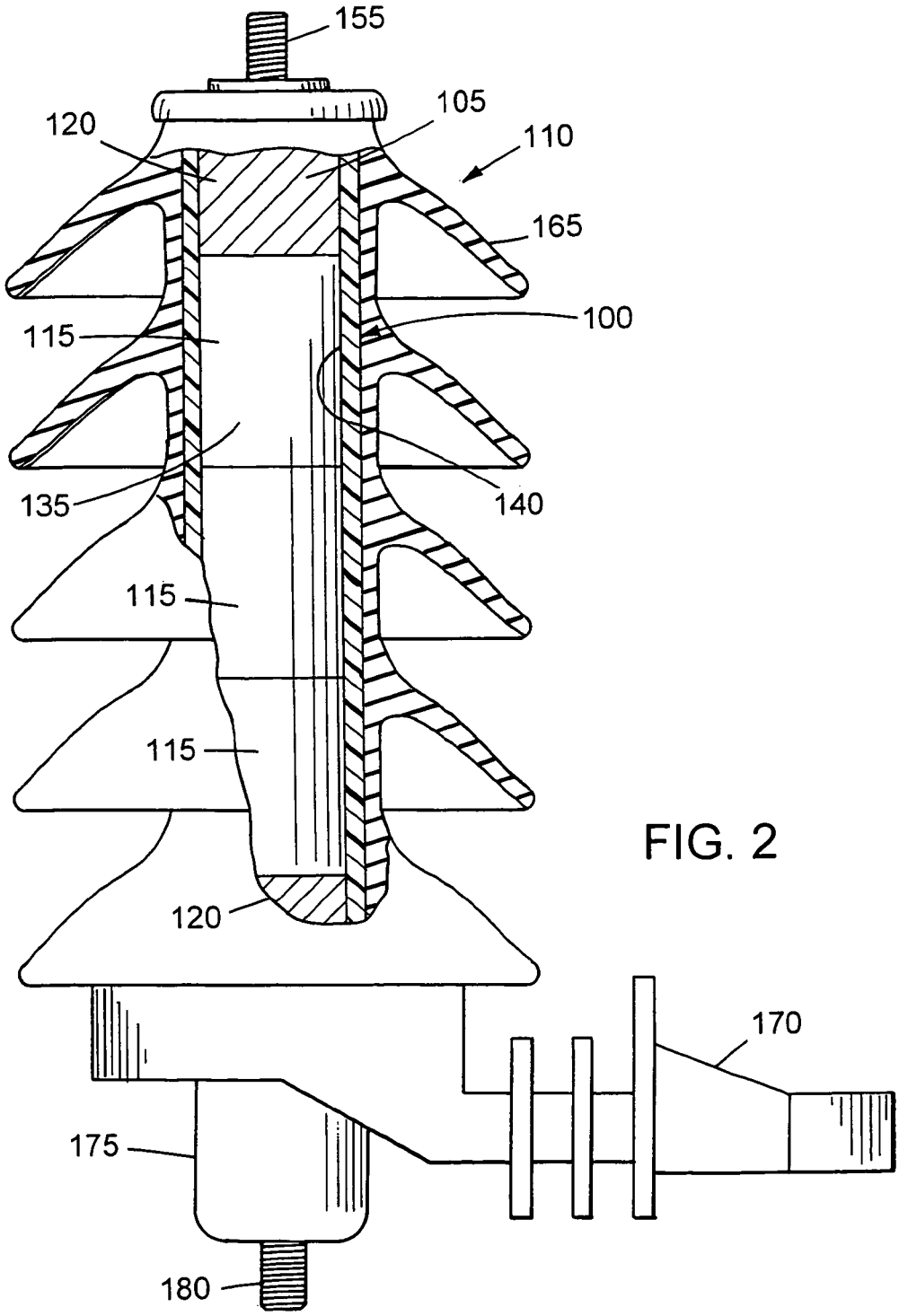
FIG. 2 is a partial cross-sectional view of the bonded electrical component module of FIG. 1 in a surge arrester.

Referring to FIGS. 1 and 2, an electrical component module 100 includes a bonded element stack 105 that serves as both the electrically-active component and the mechanical support component of a surge arrester 110. It is desirable for the bonded element stack 105 to exhibit surge durability in that it normally be able to withstand high current, short duration conditions, or other required impulse duties. For example, in one implementation of a stack for use in heavy duty distribution arresters, it is desirable to have a stack capable of withstanding 100 kA pulses with durations of 4/10 microseconds, where 4/10 indicates that a pulse takes 4 microseconds to reach 90% of its peak value and 10 microseconds more to get back down to 50% of its peak value. As described below in detail, the electrical component module 100 may be reinforced to enable it to better withstand the thermo-mechanical shock of a higher current impulse.

Elements 115 of the bonded element stack 105 are stacked in an end-to-end relationship and bonded together at their end surfaces. Since the elements 115 of the stack 105 are affirmatively bound together, the arrester 110 does not need to include a mechanism or structure for applying an axial load to the elements. The bonding supplies sufficient mechanical strength for a static load.

The surge arrester 110 may be implemented as any class of surge arrester, including a station, intermediate, or distribution class surge arrester. For example, in distribution class systems, a monolithic element of up to approximately 6 kV to approximately 9 kV may be used. A bonded disk stack may include, for example, multiples of 3 kV, 6 kV, or 9 kV elements bonded together. However, other values such as 1 kV or 10 kV may be used for the individual element, and the arrester is not limited to any particular combination of voltage ratings. It should also be understood that the module 100 may be used in other types of surge arresters, and in other electrical protective equipment.

The bonded element stack 105 may include different numbers of elements 115, and elements 115 of different sizes or types. Examples include varistors, capacitors, thyristors, thermistors, and resistors. Typically, the elements 115 are cylindrical, though the elements 115 may include other shapes as well. For purposes of explanation, the stack is shown as including three metal oxide varistors ("MOVs") 115 and a pair of terminals 120.

Figure 3:
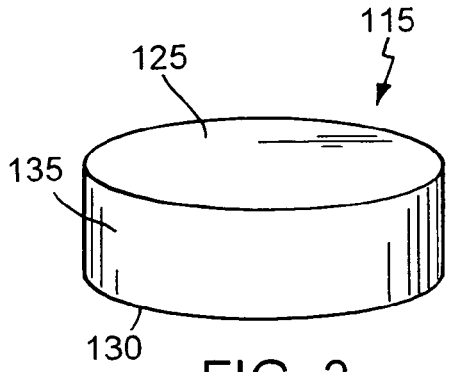
FIG. 3 is a perspective view of one varistor (MOV disk) of the bonded electrical component module of FIGS. 1 and 2.

Referring also to FIG. 3, each MOV 115 is made of a metal oxide ceramic formed into a short cylindrical disk having an upper face 125, a lower face 130, and an outer cylindrical surface 135. The metal oxide ceramic used in the MOV 115 may be of the same material formulation used for any MOV disk.

The MOVs may be sized according to the desired application. For example, in one set of implementations, the MOV may have a diameter between approximately 1 to 3 inches, such that the upper and lower faces 125, 130 each have surface areas of between about 0.785 and 7.07 square inches.

Given a particular metal oxide formulation and a uniform or consistent microstructure throughout the MOV, the thickness of the MOV determines the operating voltage level of the MOV. In one implementation, each MOV is about 0.75 inches thick. In some implementations, this thickness may be tripled.

It is desirable to minimize the cross-sectional areas of the MOVs so as to minimize the size, weight and cost of the arrester. However, the durability and recoverability of the MOVs tend to be directly related to the sizes of the MOVs. In view of these competing considerations, MOVs having diameters of approximately 1.6 inches have been used.

The upper and lower faces 125, 130 may be metallized using, for example, sprayed-on coatings of molten aluminum or brass. In some implementations, these coatings have a thickness of approximately 0.002 to 0.010 inches. The outer cylindrical surface 135 is covered by an insulative collar.

A terminal 120 is disposed at each end of the stack 105. Each terminal 120 typically is a relatively short, cylindrical block formed from a conductive material, such as, for example, aluminum. Each terminal 120 has a diameter substantially equal to that of an MOV 115. In some implementations, each terminal also may include a threaded bore 150 in which may be positioned a threaded conductive stud 155. In general, the terminals 120 may be thinner than terminals associated with modules that, for example, are encased with a structural layer to provide an axial load on the components of the module. This reduced thickness may result from changes in the geometry of the device, or simply because thicker metal is not needed for bonding with the structural layer.

As shown in FIG. 2, the surge arrester 110 includes the electrical component module 100, a polymeric or ceramic housing 165, and an arrester hanger 170. The module 100 is disposed within the housing 165. An insulating or dielectric compound (not shown), such as room temperature vulcanized silicone, fills any voids between the module 100 and the inner surface 140 of the housing 165. A threaded conductive stud 155 is disposed in the bore 150 of each terminal 120. The upper stud 155 typically extends beyond the housing 165 and includes threads for engaging a terminal assembly (not shown). The lower stud 155 typically extends through an aperture (not shown) in hanger 170 for connection to a ground lead disconnector 175. A threaded stud 180 extends from the disconnector 175 to engage a ground lead terminal assembly (not shown). The housing 165 is sealed about the upper and lower ends of the module 100.

As noted above, elements of the bonded element stack 105 may be bonded together at their end faces, such that the stack 105 serves as both the electrically-active component and the mechanical support structure of an electrical protective device, such as the surge arrester 110. The bonding provides a mechanically-compliant, electrically-conductive joint between the MOVs, which reduces the deleterious effects of the thermo-mechanical forces associated with service operating conditions and thus lengthens the expected service life of the surge arrester.

The bonding may be implemented to form a mechanically-compliant joint using combinations of electrically-conductive materials and mechanically-compliant materials. In general, the joint reduces or dampens axial tensile forces by having a Young's modulus substantially below that of the disks that it separates and bonds. For example, the necessary compliance of the joint is achieved by the joint having Young's modulus that is less than half of the Young's modulus of the MOV disk. More particularly, the Young's modulus of the joint may be between approximately one-eightieth and one-tenth of the Young's modulus of the electrical components separated by the joint. Even more particularly, the Young's modulus of the joint may be approximately one-fortieth of the Young's modulus of the electrical components. For example, in one implementation, the disks have a Young's modulus of 16,000,000 pounds per square inch (psi), and the joint has a Young's modulus of approximately 400,000 psi. In some applications, the joint will have a thickness of approximately 0.25 inches. The bonding joint also may be implemented using a single material that is electrically-conductive and mechanically-compliant. The MOV disks optionally may be metallized with, for example, copper, aluminum, or brass. Examples of the electrically-conductive and mechanically-compliant joint are described in U.S. application Ser. No. 09/577,837, filed May 25, 2000, by Michael M. Ramarge, David P. Bailey, Thomas C. Hartman, Roger S. Perkins, Alan P. Yerges, Michael G. Scharrer, and Lisa C. Sletson, titled "Compliant Joint Between Electrical Components," which is incorporated by reference.

In the above examples, the adhesive can be, for example, a polymer, such as a polyimide, polyamide, polyester, polyurethane, elastomer, silicone, or epoxy. The adhesive can be made electrically-conductive by adding a conductive material, such as silver, a silver alloy, and/or carbon black. The polymer and polymer composite laminates of the examples described above also can be one or more of the polymers listed above. The polymer composite laminates may be fiber reinforced, or formulated with fillers, such as reinforcing fillers to modify the mechanical properties of the laminate, or extending fillers to modify the physical properties of the laminate. The polymers and polymer composite laminates can be made electrically-conductive by adding conductive materials, such as silver, silver alloys, and/or carbon black.

In general, the joints described above will function between any pair of components in which a mechanically-compliant and electrically-conductive joint is necessary or desirable. For example, the joints described above can be formed between different electrical components, such as between an end terminal and a MOV disk.

Figure 4:
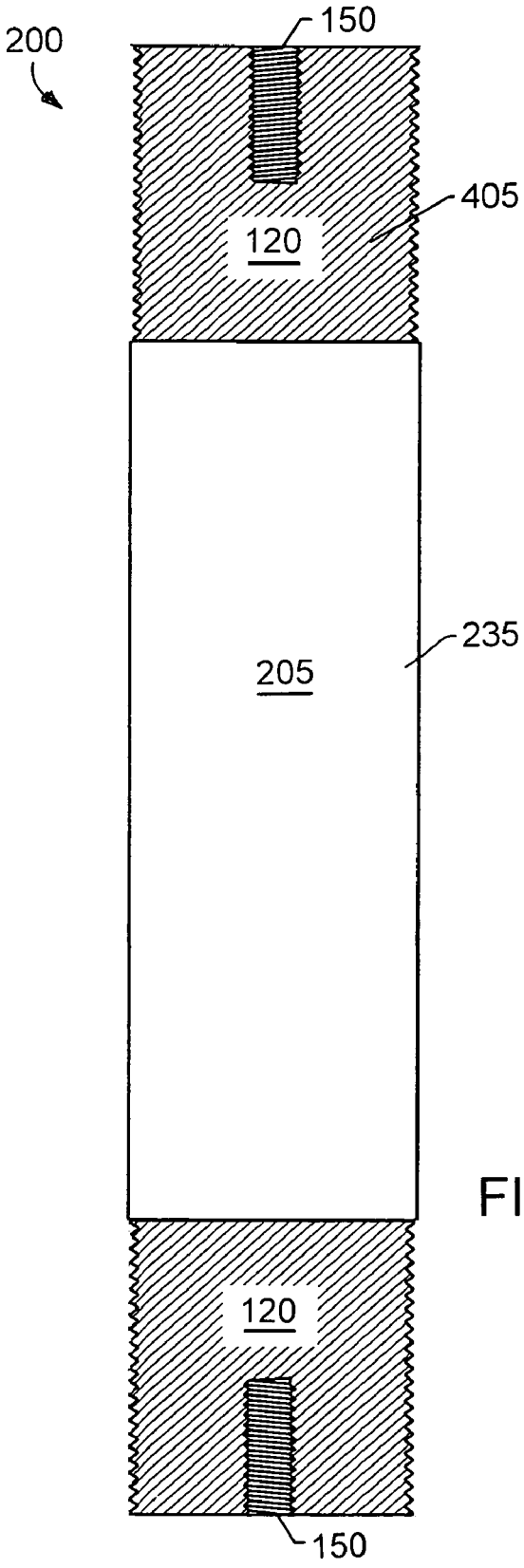
FIG. 4 is a cross-sectional view of an electrical component module showing a monolithic electrical component.
Figure 5:
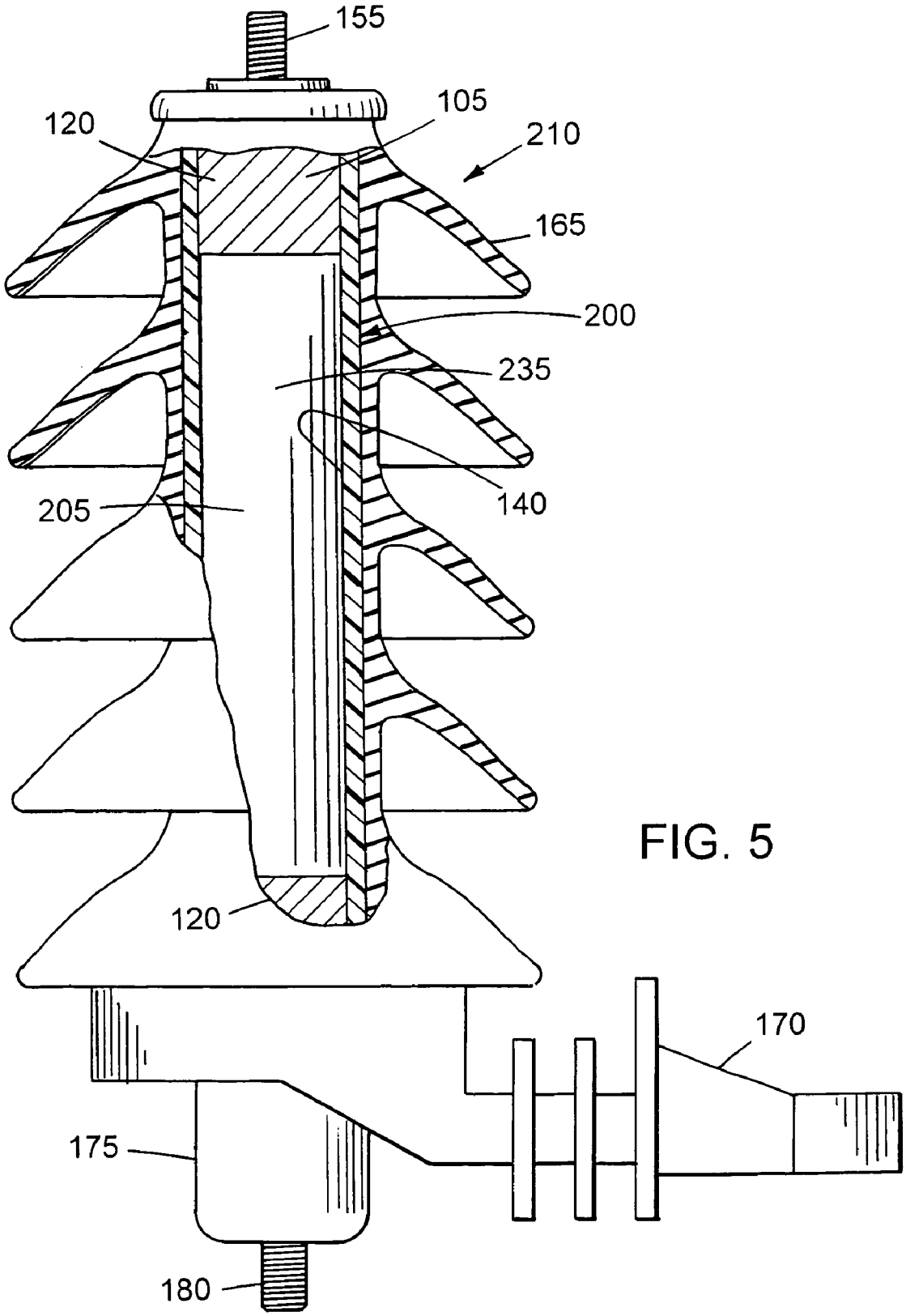
FIG. 5 is a partial cross-sectional view of the monolithic electrical component module of FIG. 4 in a surge arrester.

Referring to FIGS. 4 and 5, an electrical component module 200 includes a monolithic element 205 that serves as both the electrically-active component and the mechanical support component of a surge arrester 210. The monolithic element 205 may be used in place of the bonded disk stack 105 of FIGS. 1 and 2. The element 205 exhibits surge durability, in that it can normally withstand high current, short duration conditions, or other required impulse duties. Moreover, since the element 205 is a single piece, the arrester 210 does not need to include a mechanism or structure for applying an axial load for mechanical support in static conditions. The monolithic element 205 supplies sufficient mechanical strength for a static load.

The length or thickness of a monolithic element is limited because the thermo-mechanical forces associated with some impulses will crack the element. For example, because of the likelihood of cracking, most monolithic elements do not exceed a rating of 9 kV. As described below in detail, the electrical component module 200 may be reinforced to enable it to better withstand the thermo-mechanical shock of a high current impulse. In this manner, the monolithic element can be lengthened beyond the length of conventional 9 kV monolithic elements. The ability to use longer monolithic elements provides considerable cost savings in the manufacture of the elements and the manufacture of surge arresters incorporating the monolithic elements.

Like the surge arrester 110, the surge arrester 210 may be implemented as any class of surge arrester, including a station, an intermediate, and a distribution class surge arrester. For example, a monolithic element typically may be used in distribution systems of up to approximately 6 kV to approximately 9 kV. As noted above, a monolithic element with a rating greater than 9 kV has an increased likelihood of cracking during an impulse. Thus, monolithic elements having a rating greater than 9 kV generally are not used in conventional applications. It should be understood that the module 200 may be used in other types of surge arresters, and in other electrical protective equipment.

The monolithic element 205 may be configured in different sizes or types, such as varistors, capacitors, thyristors, thermistors, and resistors. Typically, the element 205 is cylindrical, though the element 205 may be configured in other shapes as well. For purposes of explanation, the surge arrester 210 is shown as including a single monolithic MOV 205 and one pair of terminals 120.

Figure 6:
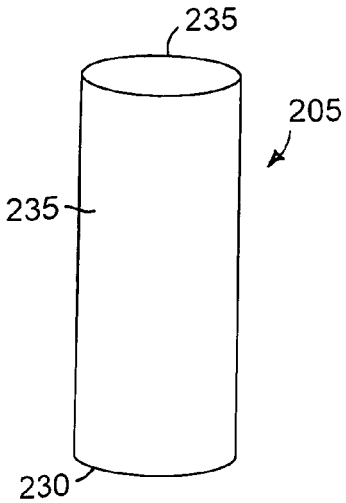
FIG. 6 is a perspective view of the monolithic varistor (MOV disk) of the electrical component module of FIGS. 4 and 5.

Referring also to FIG. 6, the monolithic MOVs 205, like the MOVs 115, is made of a metal oxide ceramic formed into a short cylindrical disk having an upper face 225, a lower face 230, and an outer cylindrical surface 235. The metal oxide ceramic used in the MOV 205 maybe of the same material formulation used for any MOV disk. Also like the MOVs 115, the monolithic MOV 205 may be sized according to the desired application. For example, in one set of implementations, the monolithic MOV 205 may have a diameter between approximately one to three inches, such that the upper and lower faces 225, 230 each have surface areas of between about 0.785 and 7.07 square inches.

Given a particular metal oxide formulation and a uniform or consistent microstructure throughout the monolithic MOV 205, the thickness of the monolithic MOV determines its operating voltage level. In one implementation, the monolithic MOV 205 is about three to six inches thick. In some implementations, this thickness may be increased by, for example, as much as three inches.

A terminal 120 is disposed at each end of the monolithic MOV 205. The terminals 120 may have any or all of the features described above. For example, each terminal 120 may have a diameter substantially equal to that of the monolithic MOV 205.

As shown in FIG. 5, the surge arrester 210 includes the electrical component module 200, and, like the surge arrester 110, the polymeric or ceramic housing 165 and the arrester hanger 170. The module 200 is disposed within the housing 165. Similarly, an insulating or dielectric compound (not shown), such as room temperature vulcanized silicone, fills any voids between the module 200 and the inner surface 140 of the housing 165. The threaded conductive stud 155 is disposed in the bore 150 of each terminal 120. The upper stud 155 typically extends beyond the housing 165 and includes threads for engaging a terminal assembly (not shown). The lower stud 155 typically extends through an aperture (not shown) in hanger 170 for connection to the ground lead disconnector 175. The threaded stud 180 extends from the disconnector 175 to engage a ground lead terminal assembly (not shown). The housing 165 is sealed about the upper and lower ends of the module 200.

Referring to FIGS. 7–15, a reinforced electrical component module 300 of a surge arrester includes the bonded disk stack 105 and a reinforcing structure 305. The reinforced electrical component module 300 may be installed in the surge arrester 110 and may be disposed within the housing 165, as shown in FIG. 2 and described above. As described above in detail with respect to the surge arrester 110, the electrical component module 100 may be a bonded element stack 105 of, for example, several MOV disks 115. Although the bonded element stack 105 has sufficient mechanical strength to withstand a static load during normal operation, cracking can occur during the thermo-mechanical shock sustained during high current impulses. The cracking tends to occur at the center of the stack, and may occur, for example, at the interface between elements or at the center of the middle element. The maximum force tends to occur in the middle of the bonded disk stack. Because of the small bond line, the bonded stack has the same natural frequency of a monolithic element of equal length. The tendency of a long disk stack to crack in the middle during a high current impulse limits the length of the stack.

The reinforcing structure 305 provides mechanical reinforcement to the reinforced electrical component module 300 to permit the module to withstand the thermo-mechanical shock of a high current impulse. The structure 305 may provide mechanical reinforcement to the entire module 300 or to a selected portion of the module 300. The reinforcing structure 305 typically provides constraining forces in the axial direction and/or the circumferential hoop direction of the reinforced electrical component module 300. The constraining forces provided by the reinforcing structure 305 are sufficient to allow the reinforced module 300 to withstand the thermo-mechanical shock of a high current impulse without cracking. More particularly, the reinforcing structure 305 allows the reinforced electrical component module 300 to withstand a larger thermo-mechanical shock than could be withstood by an equivalent non-reinforced electrical component module 100.

Figure 11:
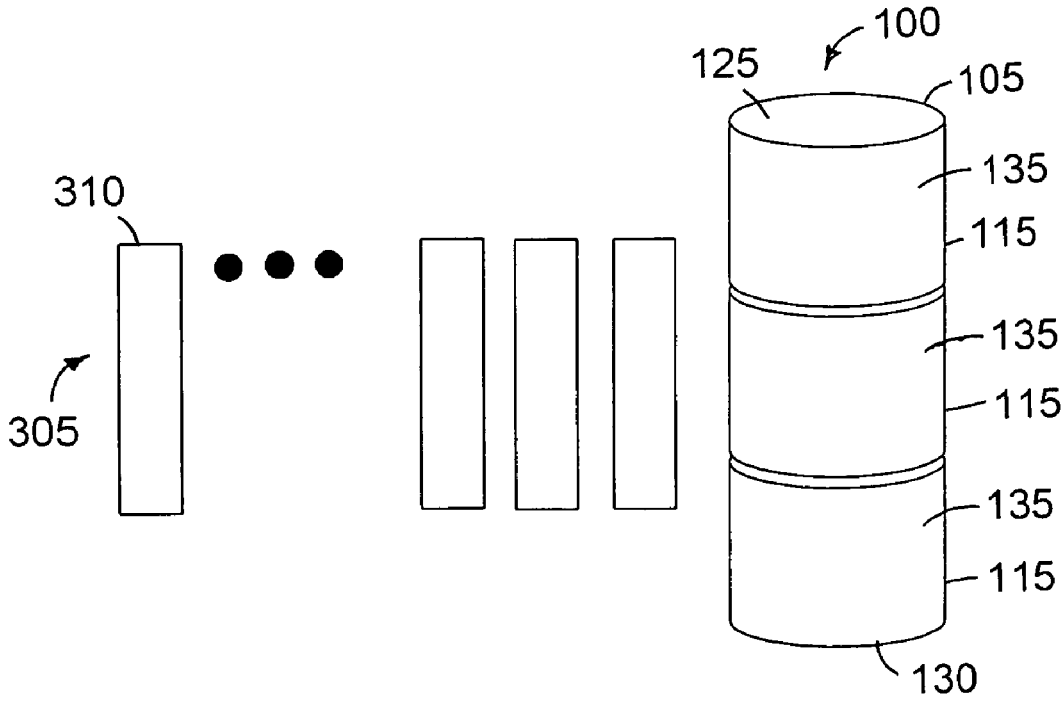
Figure 13:
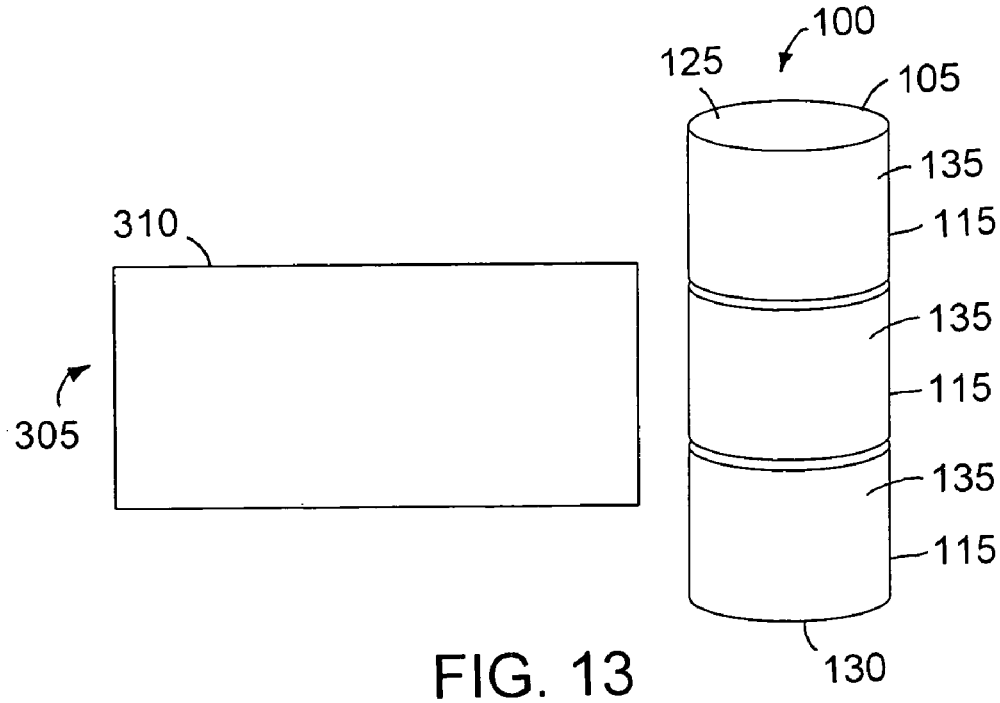
Figure 15:
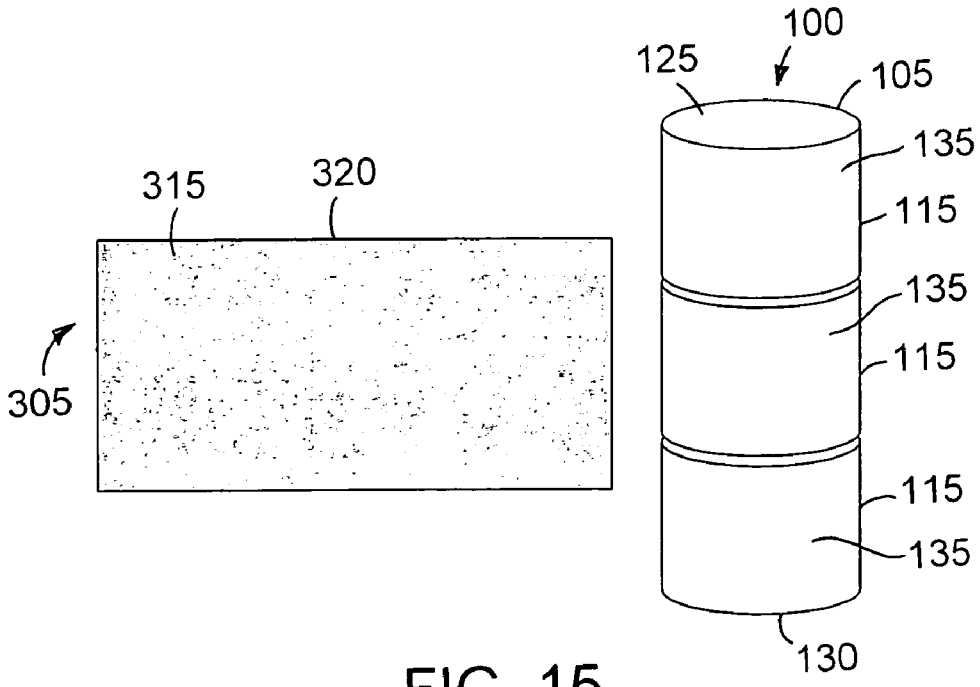

The reinforcing structure 305 is attached to the outer surface 135 of the stack 105, and may be attached to the outer surface of at least a portion of one or more elements 115 . The reinforcing structure 305 also may be applied to the upper face 125 of the topmost element and/or may be applied to the lower face 130 of the bottommost element. The reinforcing structure typically is applied vertically (i.e., longitudinally) or circumferentially, or both, and may encase a portion of the upper face 125 of the topmost element and/or the lower face 130 of the bottommost element. Where there is more than one element, the reinforcing structure 305 typically is applied to the outer surface 135 of each element 115 of the bonded disk stack 105. However, as shown in FIGS. 11, 13, and 15, the reinforcing structure may be applied to a selected area of the outer surface 135 of the disk stack.

The reinforcing structure 305 may include at least one layer of a pre-impregnated fiber matrix 310. The fiber matrix may be any woven or interwoven fabric, sheet, tape or strip. The fiber matrix may take other forms, such as, for example, a collection of fiber segments. The fiber matrix may encompass any form factor, and may be narrow or wide as needed to selectively reinforce the bonded disk stack or monolithic element. The fiber matrix typically has a preformed woven or interwoven pattern. The fiber matrix is pre-impregnated with resin, and is applied to the electrical elements as desired. The pre-impregnated fiber matrix 310 is pre-formed and typically has fibers oriented in a set orientation. Implementations include fibers oriented to be parallel, perpendicular or at any other angle with respect to an axis of the stack 105. Another implementation includes fibers that are randomly oriented. The length of the fibers in the pre-impregnated fiber matrix 310 may be predetermined or random. Implementations include fibers that are, for example, continuous, of at least one predetermined length, or random in length. The fiber matrix 310 typically is pre-impregnated with resin. The matrix may be, for example, dipped, cast, powder cast, or otherwise pre-impregnated. The fibers may be any insulating fibrous material such as, for example, fiberglass, Kevlar, or Nextel.

Figure 7:
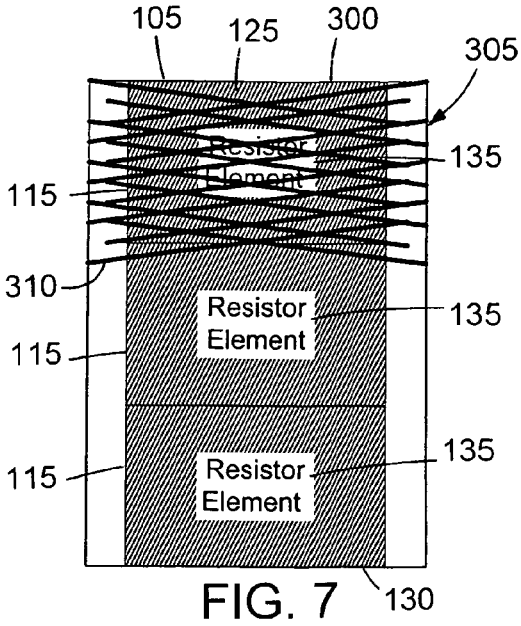
FIGS. 7–9 are cross-sectional views of reinforcing structures used with the bonded disk stack module of FIGS. 1–3.

As shown in FIG. 7, the reinforcing structure 305 may include a circumferentially-applied, pre-impregnated fiber matrix 310. The matrix 310 is made with a predetermined woven or interwoven pattern with fibers oriented at a predetermined angle. However, the matrix may also take other forms, such as, for example, a collection of fiber segments. The pattern may be, for example, a back and forth wind pattern, a circular wind pattern, or any other woven or interwoven pattern. The fiber matrix 310 may be applied to the electrical element in one or more layers that may result in a reinforcing structure having a predetermined thickness, such as, for example, approximately up to one-quarter of an inch, and more typically approximately twenty thousandths of an inch. The predetermined angle of the fibers typically is a shallow angle, but may include other angles. The angle may be, for example, between approximately 3 degrees and approximately 10 degrees. The pre-impregnated matrix 310 is typically applied to cover at least a portion of the outer surface 135 of at least one disk 115 in the stack 105. The matrix 310 also may cover or enclose at of least a portion of the upper face 125 of the topmost element and/or at least a portion of the lower face 130 of the bottommost element of the stack 105. The circumferentially-applied matrix may also be applied vertically or may be combined with, for example, the vertically-applied matrix and/or the fiber segments embedded in epoxy described below.

Figure 8:
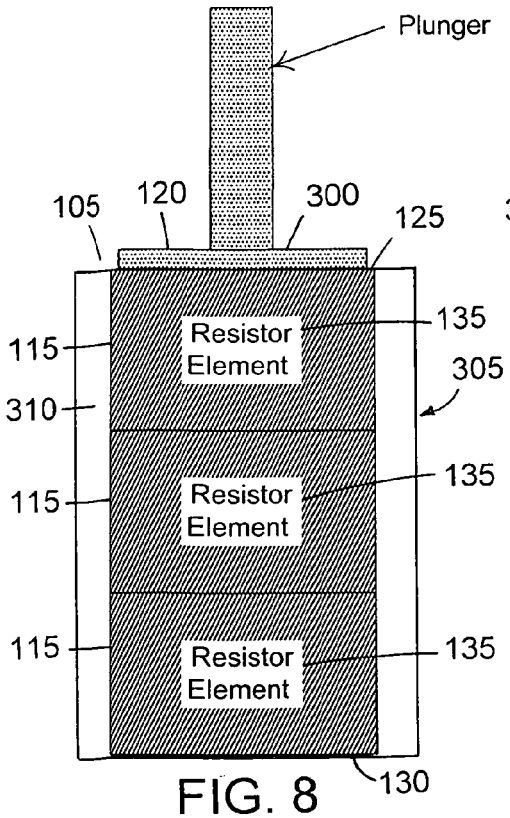
Figure 9:
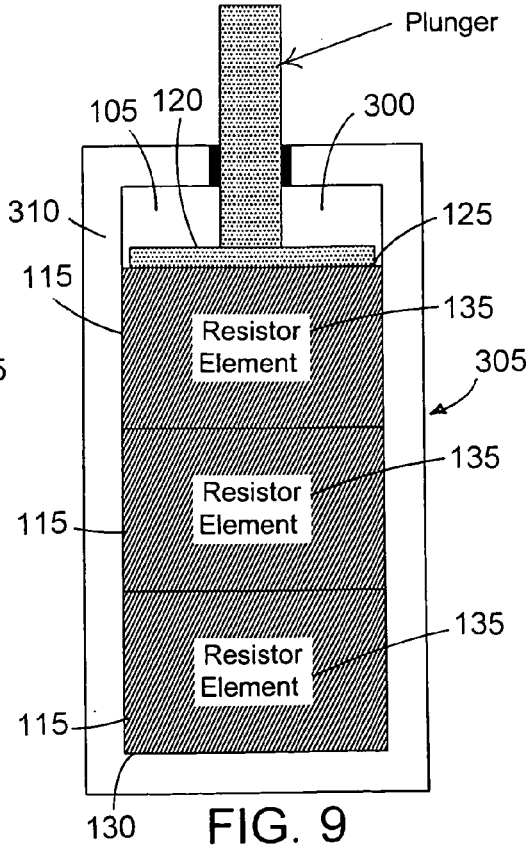

Referring to FIGS. 8 and 9, the reinforcing structure 305 may include a vertically applied, pre-impregnated fiber matrix 310. The matrix 310 may be placed in a vertical orientation along an axis of the bonded disk stack 105. The vertical application may include a pre-impregnated fiber matrix 310 applied in one or more layers to a predetermined thickness of, for example, up to one-quarter of an inch, and more typically approximately twenty thousandths of an inch. The vertical application typically covers at least a portion of the outer surface 135 of at least one disk 115 in the stack 105. As shown in FIG. 9, the vertical application also may cover or enclose at least a portion of the upper face 125 of the topmost element and/or at least a portion of the lower face 130 of the bottommost element of the stack 105. The vertically-applied matrix may also be applied circumferentially or may be combined with other patterns, such as, for example, the circumferentially-applied matrix described above and/or the fiber segments embedded in epoxy described below.

Figure 10:
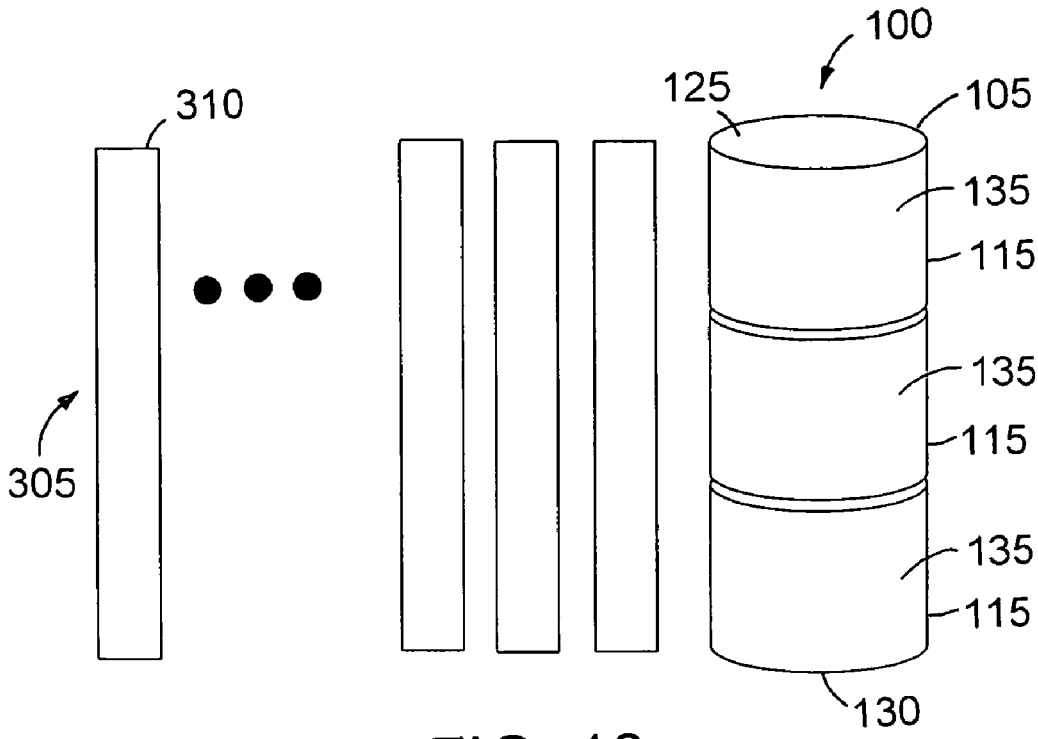
FIGS. 10–15 are plan views of reinforcing structures applied to the bonded disk stack module of FIG. 1.

Referring to FIGS. 10 and 11, the reinforcing structure 305 may include one or more vertically-applied pieces of pre-impregnated fiber matrix 310. A predetermined number of pieces of pre-impregnated fiber matrix 310 may be attached to at least a portion of the outer surface 135 of at least one disk 115. The pieces of pre-impregnated fiber matrix 310 are vertically oriented along an axis of the stack 105. The reinforcing structure 305 may reinforce the entire length of the stack 105 or may reinforce only a selected portion of the stack and/or a selected portion or all of the outer surface 135 of the stack 105.

Figure 12:
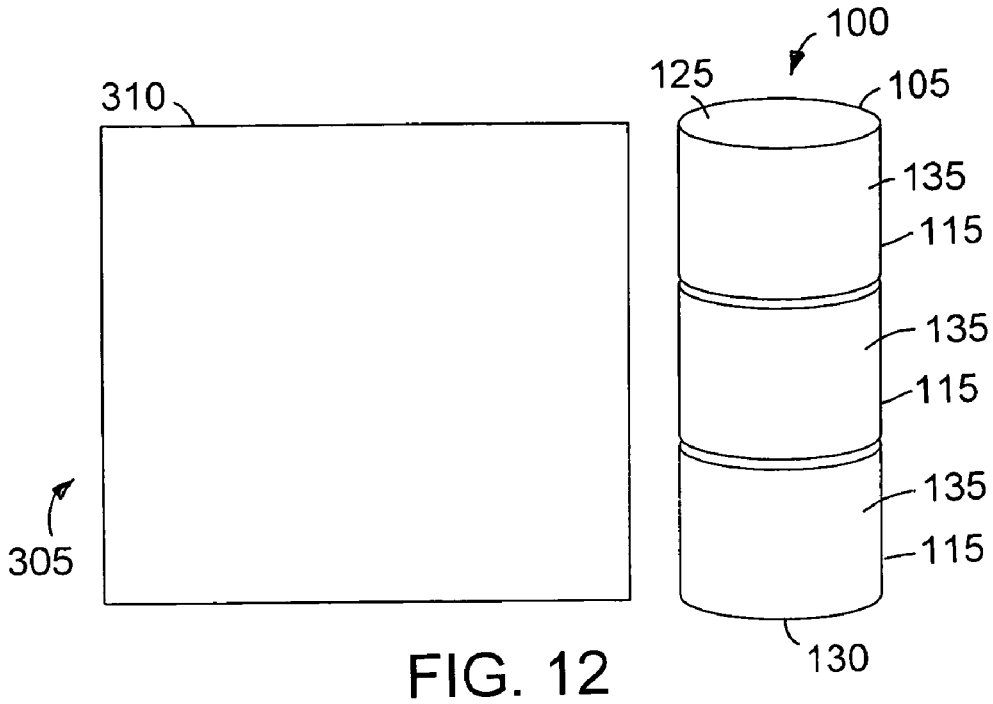

Referring to FIGS. 12 and 13, the reinforcing structure 305 may include a single piece of pre-impregnated fiber matrix 310. The piece of pre-impregnated fiber matrix 310 is vertically oriented along an axis of the bonded disk stack 105, and is sufficiently wide to cover all or the majority of the outer surface 135 of the stack 105. The reinforcing structure 305 may reinforce a selected portion or the entire length of the stack 105 and/or a selected portion or all of the outer surface 135 of the stack 105.

Figure 14:
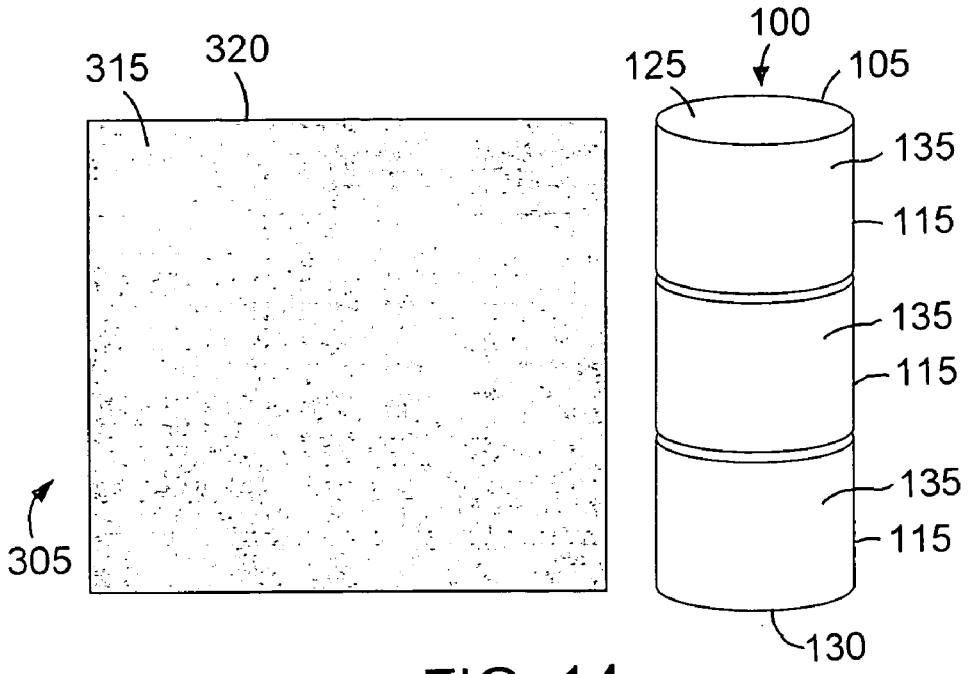

Referring to FIGS. 14 and 15, the reinforcing structure 305 may include a mixture of fiber segments 315 embedded in a resin 320. The fiber segments may all be of a uniform length or may include fibers of varying lengths. The orientation of the fiber segments may be a predetermined orientation or a random orientation. The stack 105 then is at least partially coated with the mixture. Any coating technique may be used to coat the stack 105 with the mixture such as, for example, dipping or powder coating. The reinforcing structure 305 may reinforce the entire length of the stack 105 or may reinforce only a selected portion of the stack and/or a selected portion or all of the outer surface 135 of the stack 105.

The reinforcing structure 305 increases the resistance of the stack 105 to impulse cracking. In this manner, the length or thickness of the stack can be increased without a subsequent increase in the risk of cracking during an impulse. The stack also can be left at a conventional length so as to provide a decreased likelihood that the stack will crack as compared to a non-reinforced stack of the same dimensions. To minimize the cost of reinforcement, the reinforcing structure can be placed only in those areas where the crack is likely to occur, which typically is in the area around and including the center of the stack along its length.

Referring to FIGS. 16–24, a reinforced electrical component module 400 of a surge arrester includes the monolithic MOV 205 and a reinforcing structure 405. The reinforced electrical component module 400 may be incorporated in the surge arrester 210 within the polymeric or ceramic housing 165, as shown in FIG. 5 and described above. The reinforced electrical component module 400 is a monolithic disk stack 205 and may be, for example, an MOV disk. Although the monolithic disk stack 205 has sufficient mechanical strength to withstand a static load during normal operation, cracking can occur during the thermo-mechanical shock sustained during high current impulses. The cracking tends to occur at the center of the monolithic disk because the maximum force tends to occur there. The tendency of a long monolithic MOV to crack in the middle during a high current impulse limits the length of the MOV, which increases the cost of surge arresters with high impulse ratings and/or limits the applicability of monolithic MOVs in surge arresters.

The reinforcing structure 405 is used to provide mechanical reinforcement to the electrical component module 205 in order to withstand the thermo-mechanical shock of a high current impulse, and may provide mechanical reinforcement to the entire reinforced electrical component module 400 or to a selected portion of the reinforced electrical component module 400. The reinforcing structure 405 typically provides axial and/or circumferential constraining forces around the reinforced electrical component module 400. The constraining forces provided by the reinforcing structure 405 are sufficient to allow the reinforced electrical component module 400 to withstand the thermo-mechanical shock of a high current impulse without cracking.

The reinforcing structure 405 is attached to at least a portion of the outer surface 235 of the monolithic MOV 205. The reinforcing structure 405 also may be applied to the upper face 225 of the MOV 205 and/or may be applied to the lower face 230 of the MOV 205.

The reinforcing structure 405 may include at least one layer of pre-impregnated fiber matrix 410. The pre-impregnated fiber matrix 410 typically has fibers oriented in a predetermined orientation. Implementations include fibers oriented to be parallel, perpendicular, or at any other angle with respect to an axis of the MOV 205. Another implementation includes fibers that are randomly oriented. The length of the fibers in the pre-impregnated fiber matrix 410 may be predetermined or random. Implementations include fibers that are, for example, continuous, of at least one predetermined length, or random in length. The fiber matrix 410 typically is pre-impregnated with resin. The fiber matrix may be, for example, dipped, cast, powder cast, or otherwise pre-impregnated. The fibers may be made of any insulating fibrous material. For example, the fibers may be made of fiberglass, Kevlar, or Nextel.

Figure 16:
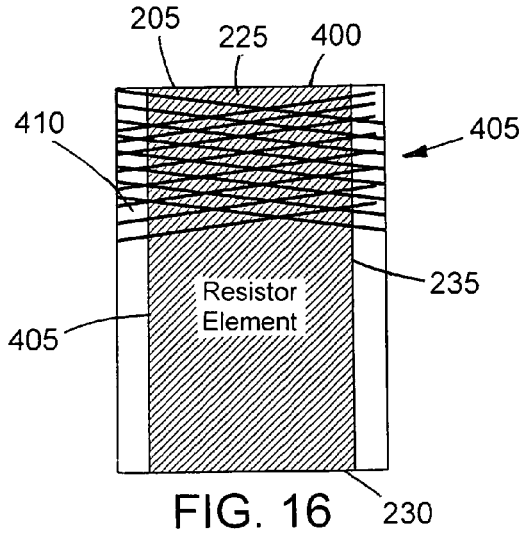
FIGS. 16–18 are cross-sectional views of reinforcing structures used with the monolithic electrical component module of FIGS. 4–6.

As shown in FIG. 16, the reinforcing structure 405 may include a circumferentially-applied, pre-impregnated fiber matrix 410. The matrix 410 is made with a predetermined woven or interwoven pattern with fibers oriented at a predetermined angle. The pattern may be, for example, a back and forth wind pattern, a circular wind pattern, or any other woven or interwoven pattern. The fiber matrix may be applied to the electrical element in one or more layers to a predetermined thickness, such as, for example, approximately up to one-quarter of an inch, and more typically approximately twenty thousandths of an inch. The predetermined angle of the fibers typically is a shallow angle, but may include other angles. The angle may be, for example, between approximately 2 degrees and approximately 45 degrees, and more particularly, between approximately 3 degrees and approximately 10 degrees. The pre-impregnated fiber matrix typically is applied to cover at least a portion of the outer surface 235 of the monolithic stack 205. The fiber matrix also may cover or enclose at least a portion of the upper face 225 and/or at least a portion of the lower face 230 of the monolithic stack 205. The circumferentially applied fiber matrix may be applied vertically or may be combined with, for example, the vertically applied matrix or the fiber segments embedded in epoxy described below.

Figure 17:
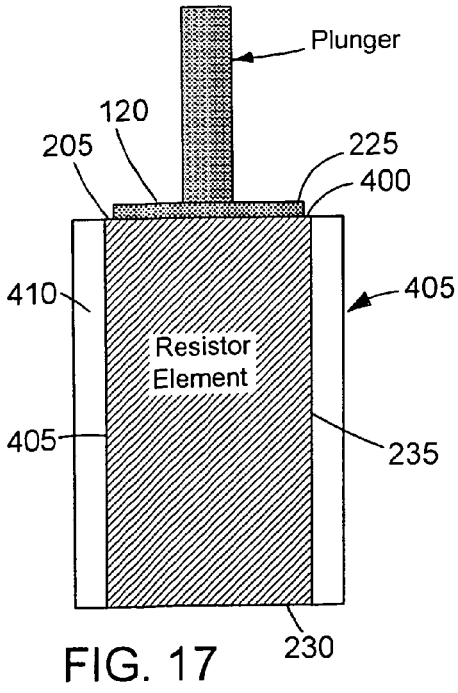
Figure 18:
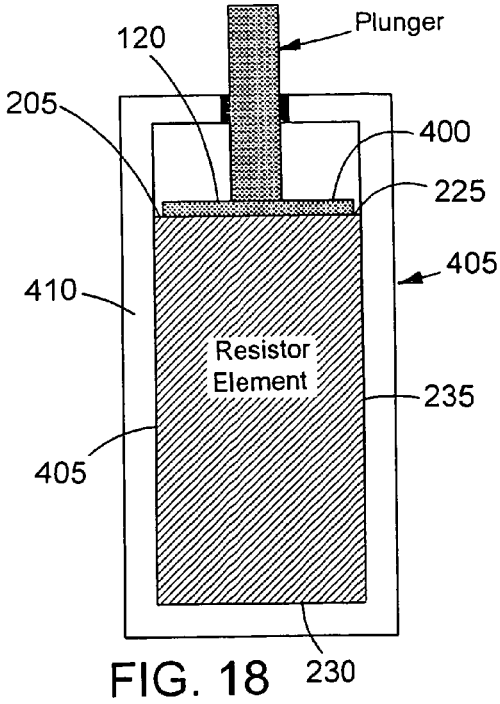

Referring to FIGS. 17–18, the reinforcing structure 405 may include a vertically-applied, pre-impregnated fiber matrix 410. The matrix 410 may be placed in a vertical orientation along an axis of the monolithic MOV 205. The vertical application may include at least one piece of fiber matrix 410 that may be arranged in one or more layers to a predetermined thickness of, for example, up to one-quarter of an inch, and more typically approximately twenty thousandths of an inch. The vertical application typically covers at least a portion of the outer surface 235 of the monolithic MOV 205. The vertical application also may cover or enclose at least a portion of the upper face 225 and/or at least a portion of the lower face 230 of the monolithic MOV 205. The vertical application pattern may be applied circumferentially or may be combined with, for example, the circumferentially-applied matrix described above or the fiber segments embedded in epoxy described below.

Figure 19:
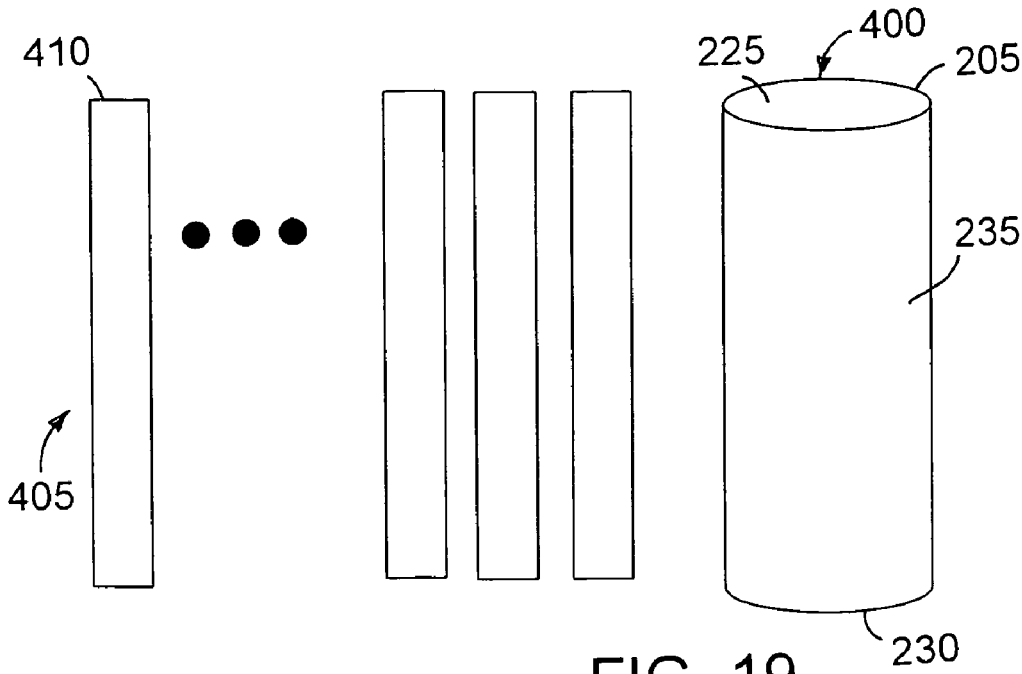
FIGS. 19–24 are plan views of reinforcing structures applied to the monolithic electrical component module of FIG. 4.
Figure 20:
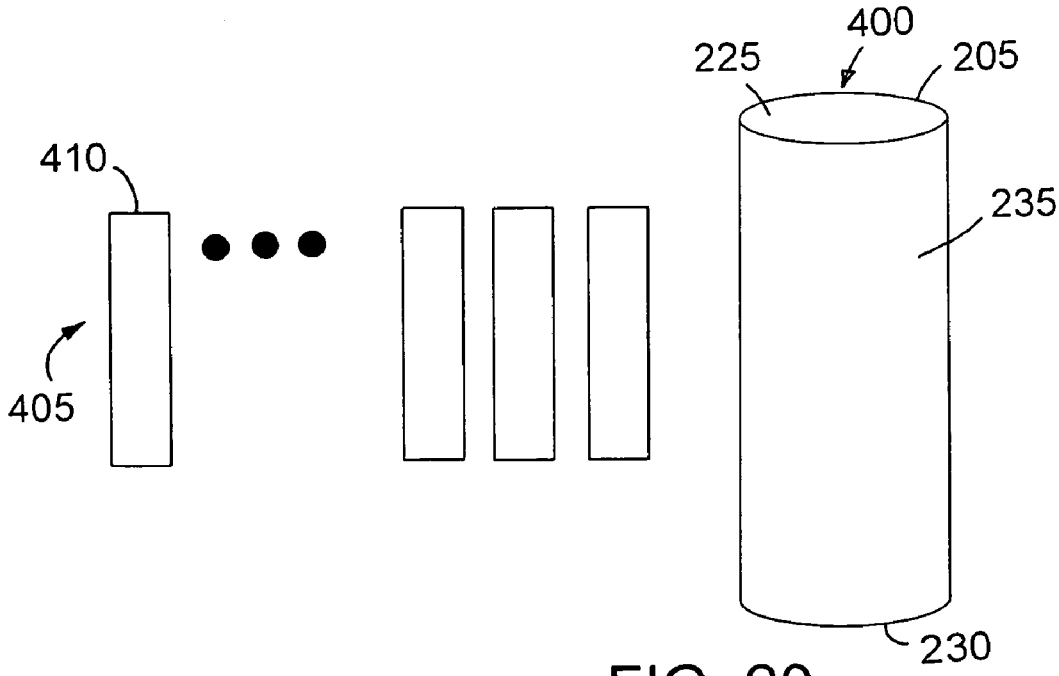

Referring to FIGS. 19 and 20, the reinforcing structure 405 may include one or more vertically-applied pieces of pre-impregnated fiber matrix 410. A predetermined number of pieces of pre-impregnated fiber matrix 410 may be attached to at least a portion of the outer surface 235 of the monolithic stack 205. The pieces of pre-impregnated fiber matrix 410 are vertically oriented along an axis of the stack 205. The reinforcing structure 405 may reinforce the entire length of the stack 205 or may reinforce only a selected portion of the stack and/or a selected portion or all of the outer surface 135 of the stack 105.

Figure 21:
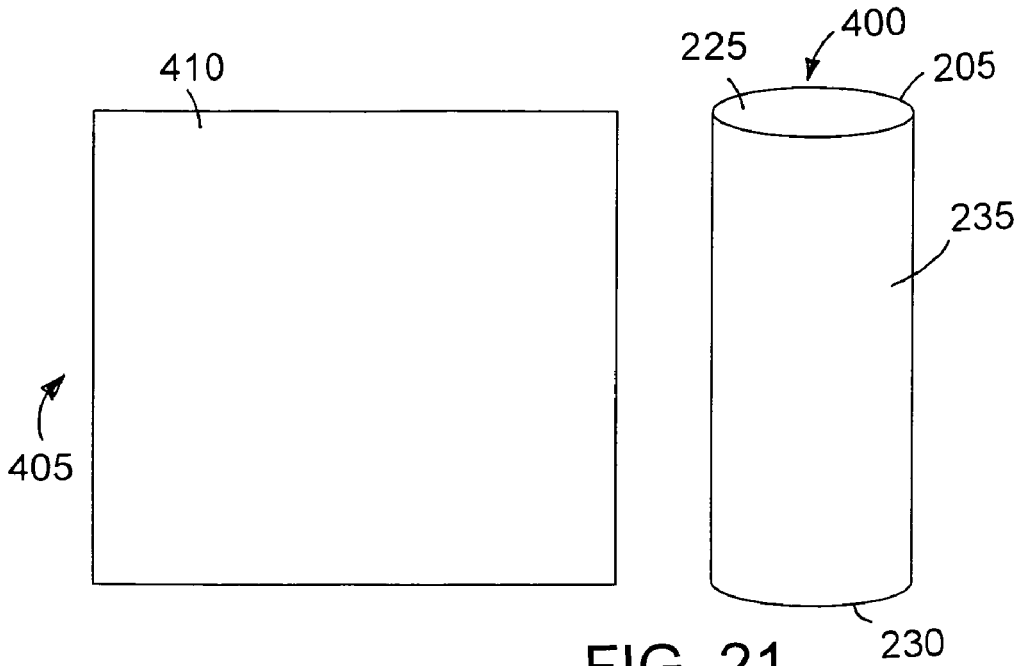
Figure 22:
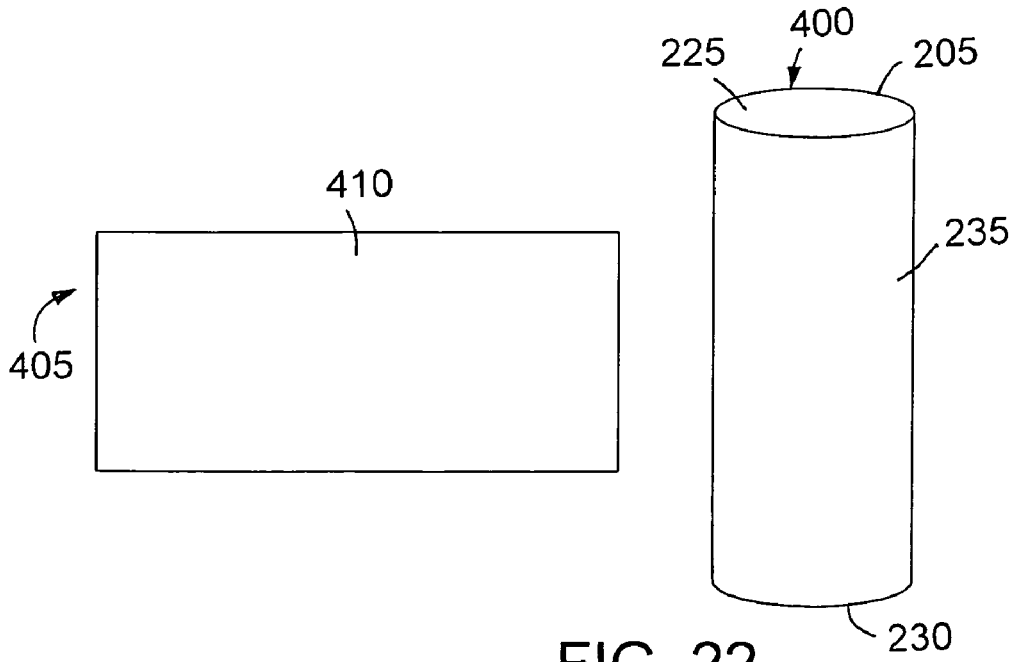

Referring to FIGS. 21 and 22, the reinforcing structure 405 may include only a single piece of pre-impregnated fiber matrix 410. The piece of pre-impregnated fiber matrix 410 is vertically oriented along an axis of the stack 205, and is sufficiently wide to cover all or the majority of the outer surface 235 of the stack 205. The reinforcing structure 405 may reinforce the entire length of the stack 205 or may reinforce only a selected portion of the stack and/or a selected portion or all of the outer surface 135 of the stack 105.

Figure 23:
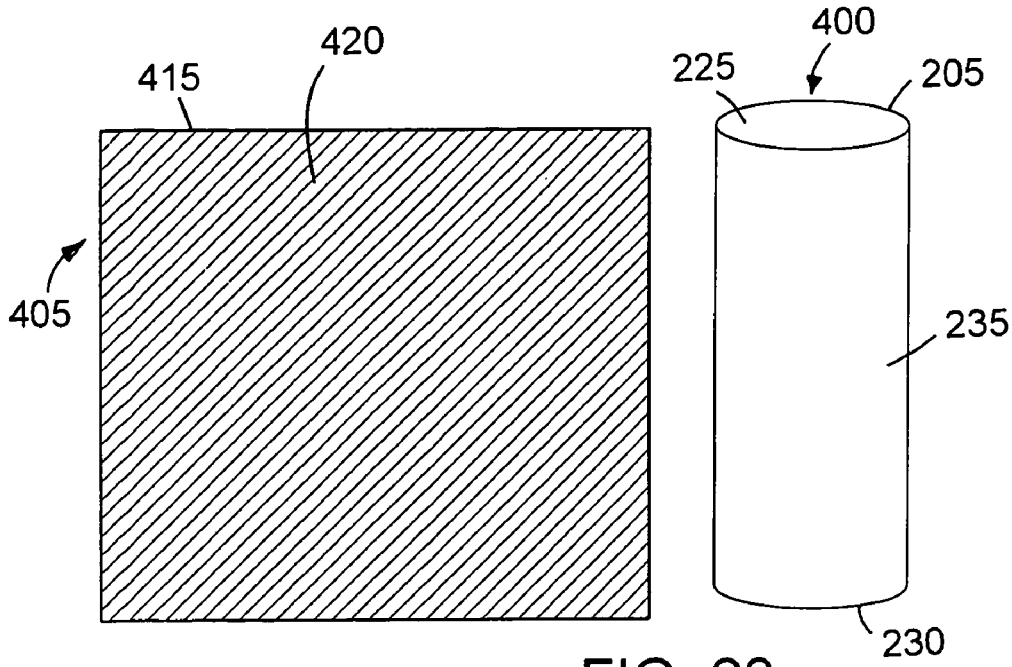
Figure 24:
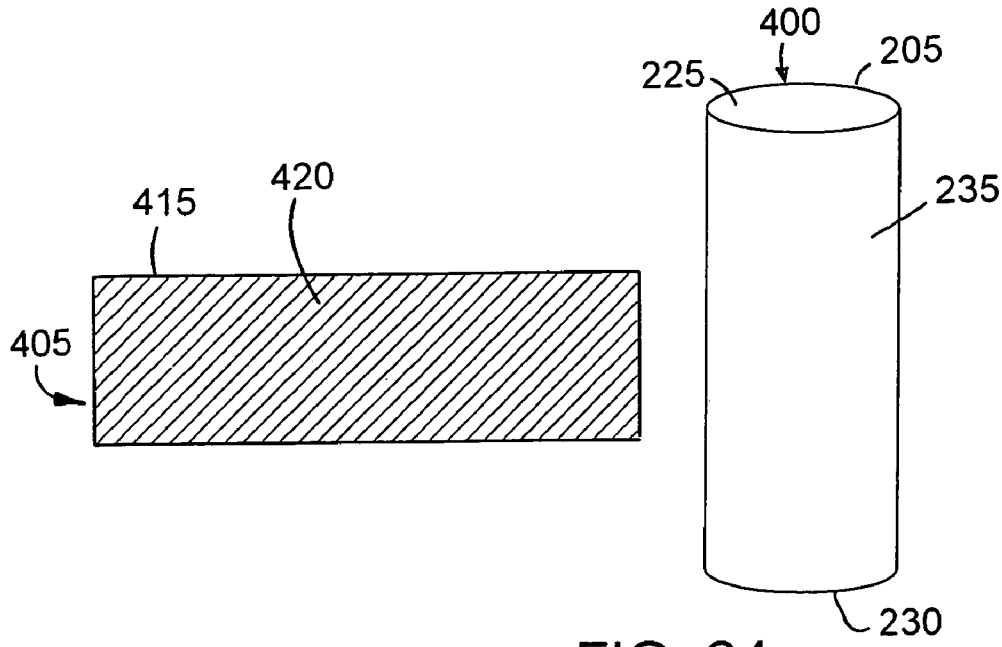

Referring to FIGS. 23 and 24, the reinforcing structure 405 may include a mixture of fiber segments 415 embedded in a resin matrix 420, with the mixture at least partially coating the stack 205. The fiber segments may all be of a uniform length or may include fiber segments of varying lengths. The orientation of the fiber segments may be a predetermined orientation or a random orientation. Any coating technique may be used to coat the stack 205 with the mixture such as, for example, dipping or powder coating. The reinforcing structure 405 may reinforce the entire length of the stack 205 or may reinforce only a selected portion of the stack and/or a selected portion or all of the outer surface 135 of the stack 105.

The reinforcing structure 405 increases the resistance of the monolithic MOV 205 to impulse cracking. In this manner, the length or thickness of the MOV can be increased without a subsequent increase in the risk of cracking during an impulse. The MOV also can be left at a conventional length so as to have a decreased likelihood of cracking relative to a non-reinforced monolithic MOV of the same dimensions. To minimize the cost of reinforcement, the reinforcing structure can be placed only in those areas where the crack is likely to occur, typically in the area around and including the center of the MOV along its length. As a result, increased-length monolithic MOVs can be produced that are longer than those currently used in surge arresters. Also, the use of bonded disk stacks becomes practical. Thus, this use will increase the applicability of monolithic MOVs to bonded disk stack surge arresters as well as monolithic surge arresters.

Figure 25:
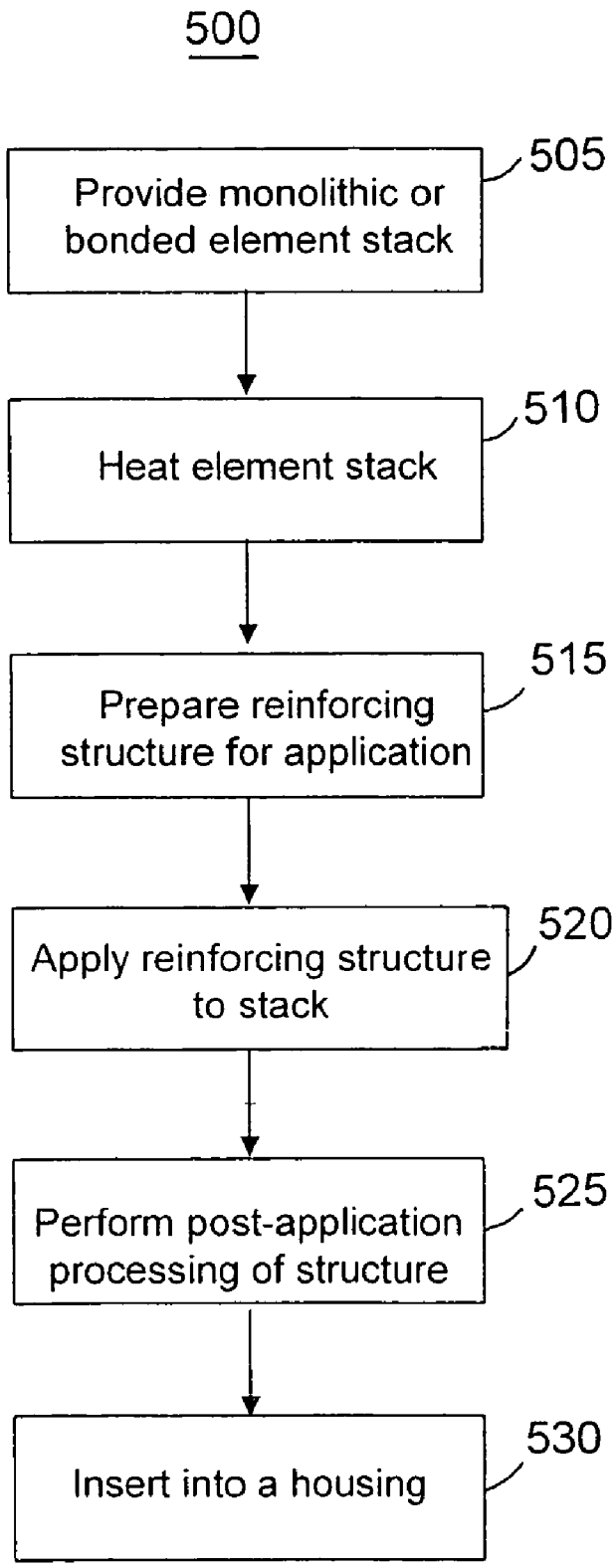
FIG. 25 is a flow chart of a method of reinforcing an electrical element.

FIG. 25 shows a method 500 of reinforcing an electrical apparatus, such as the surge arresters 110, 210. The surge arrester 110, 210 includes the electrical component module 100, 400, respectively, which may include, for example, a bonded disk stack 105 or a monolithic MOV 205, respectively. Initially, a component module 100, 400 including, for example, the bonded disk stack 105 or the monolithic MOV 205 is provided (step 505). The stack or MOV is heated to between approximately 100° F. and approximately 200° F. and more particularly to between approximately 150° F. and approximately 180° F., and even more particularly to approximately 170° F. using, for example, an oven or a forced air heat gun (step 510). In general, the stack or MOV is heated to a temperature that is sufficient to cause the resin in the pre-impregnated fiber matrix to become tacky or melt. The temperature can be varied to adjust the tackiness, viscosity, or flowability of the resin as desired during the fabrication of the surge arrester.

The reinforcing structure 305, 405, which may include at least one layer of pre-impregnated fiber matrix 310, 410, is prepared for application to the component module 100, 400 (step 515). For example, the fiber matrix 310, 410 maybe embedded in an epoxy matrix, or the fibers of the matrix 310, 410 may be oriented in a predetermined or random direction. In another implementation, fiber segments 315, 415 may be mixed in an epoxy 320, 420. The fibers 315, 415 may be, for example, of a predetermined length or a random length.

The reinforcing structure 305, 405 is applied to the component module 100, 400 (step 520). For example, the reinforcing structure 305 may be applied to at least a portion of at least one disk 115 of a bonded disk stack 105, or the reinforcing structure 405 may be applied to at least a portion of a monolithic disk stack 205. The reinforcing structure 305, 405 may be applied by, for example, circumferentially and/or vertically applying pre-impregnated fiber matrix 310, 410, as described above. In another implementation, the reinforcing structure 305, 405 may be applied as a coating. For example, the reinforcing structure 305, 405 may be applied as a coating of fiber segments 315, 415 mixed in resin 320, 420, as described above.

Post-application processing is performed on the reinforcing structure 305, 405 after it is applied to the component module 100, 400 (step 525). The post-application processing may include curing of the resin, such as heating the structure to between approximately 250° F. and approximately 400° F. for approximately 60 minutes to approximately 120 minutes. Again the heating may be performed in an oven or by the use of a forced air heat gun or other suitable methods. The module and structure 305, 405 then are inserted into the housing 165 (step 530). The surge arrester with the reinforced component module 100, 400 is ready to be used in service and to better withstand the thermo-mechanical shock of a high current impulse.

The reinforcing structures described above can be applied to the component module of any surge arrester, including surge arresters rated greater than 6 kV, and more particularly, rated between 6 kV and 800 kV, and can be applied to component modules to withstand a 100 kA current impulse. For example, the reinforcing structures can be applied to a component module of a 700 kV surge arrester used, for example, in a high voltage station application. Multiple layers of the fiber matrix pre-impregnated with a resin can be purchased and applied to the component module and each individual layer cured or all of the layers cured in a single step. The multiple layers serve to provide two forms of mechanical reinforcement. The first form of reinforcement is to support the structure itself and reduce the need for the housing to provide mechanical support. As such, the housing can be reduced in size and thickness. This will advantageously reduce the cost of the resulting surge arrester.

Other implementations are within the scope of the following claims.

What is claimed is:

1. An electrical apparatus comprising:

two terminals accessible from an exterior of the electrical apparatus;

an electrical element comprising a monolithic MOV disk having an outer surface and two ends, the ends being in contact with the two terminals, the monolithic MOV disk having a rating of at least 6 kV; and a reinforcing structure attached to the outer surface and constructed so as to enable the monolithic MOV disk to withstand at least one 100 kA impluse without cracking, wherein the reinforcing structure comprises a fiber matrix pre-impregnated with a resin, the fiber matrix comprising a pre-woven fabric.

2. The apparatus of claim 1 wherein the monolithic MOV disk has a rating between approximately 6 kV and approximately 800 kV.

3. The apparatus of claim 1 wherein the fibers in the fiber matrix are oriented in a predetermined orientation with respect to an axis of the electrical element.

4. The apparatus of claim 3 wherein the fibers in the fiber matrix are oriented parallel to the axis.

5. The apparatus of claim 1 wherein the fibers segments are oriented in a random orientation.

6. The apparatus of claim 1 wherein the fibers in the fiber matrix are of a uniform length.

7. The apparatus of claim 1 wherein the fibers in the fiber matrix are of a non-uniform length.

8. The apparatus of claim 1 wherein the fibers in the fiber matrix comprise fiberglass.

9. The apparatus of claim 1 wherein the fibers in the fiber matrix comprise a non-conductive material.

10. The apparatus of claim 1 wherein the fiber matrix is applied circumferentially.

11. The apparatus of claim 10 wherein the fiber matrix is applied circumferentially such that the fibers have a predetermined orientation at a predetermined angle with respect to an axis of the electrical element.

12. The apparatus of claim 11 wherein the predetermined angle is an angle less than approximately 50 degrees.

13. The apparatus of claim 12 wherein the angle is between approximately 3 degrees and approximately 10 degrees.

14. The apparatus of claim 10 wherein the circumferentially applied fiber matrix has a predetermined thickness.

15. The apparatus of claim 1 wherein the fiber matrix is applied vertically.

16. The apparatus of claim 15 wherein the vertical application comprises at least one piece of fiber matrix placed in a vertical orientation along an axis of the electrical element.

17. The apparatus of claim 15 wherein the vertical application comprises a single piece of fiber matrix placed in a vertical orientation along an axis of the electrical element and having a sufficient width to cover the majority of an outer surface of the electrical element.

18. The apparatus of claim 1 wherein the reinforcing structure further comprises at least one layer of pre-impregnated fiber matrix applied circumferentially and at least one layer of pre-impregnated fiber matrix applied vertically.

19. An electrical apparatus comprising:

an electrical element comprising a bonded disk stack having an outer surface, the bonded disk stack comprising two or more MOV disks, each disk having a face-to-face bond with each adjacent disk, the bonded disk stack having a rating of at least 6 kV; and a reinforcing structure attached to the outer surface and constructed so as to enable the bonded disk stack to withstand at least one 100 kA impulse without breaking the face-to-face bonds, wherein the reinforcing structure comprises a fiber matrix pre-impregnated with a resin, the fiber matrix comprising a pre-woven fabric.

20. The apparatus of claim 19 wherein the bonded disk stack comprises more than two MOV disk.

21. The apparatus of claim 19 wherein the fibers in the fiber matrix comprise a non-conductive material.

22. The apparatus of claim 19 wherein the fiber matrix is applied circumferentially.

23. The apparatus of claim 19 wherein the fiber matrix is applied vertically.

24. The apparatus of claim 19 wherein the reinforcing structure comprises at least one layer of pre-impregnated fiber matrix applied circumferentially and at least one layer of pre-impregnated fiber matrix applied vertically.

25. The apparatus of claim 1 wherein the reinforcing structure has a uniform thickness.

26. The apparatus of claim 1 wherein the reinforcing structure is configured to reinforce a selected portion of an area of the monolithic MOV disk along a lengthwise axis of the disk.

27. The apparatus of claim 26 wherein the selected portion of the area comprises less than all of the area.

28. The apparatus of claim 26 wherein the selected portion of the area comprises an area excluding the ends of the monolithic MOV disk.

29. The apparatus of claim 26 wherein the selected portion of the area comprises an area including a center of the monolithic MOV disk.

30. The apparatus of claim 3 wherein the predetermined orientation is based upon the orientation of the fabric with respect to the axis.

31. The apparatus of claim 3 wherein the predetermined orientation is based upon a woven pattern of the fibers in the pre-woven fabric.

32. The apparatus of claim 3 wherein the predetermined orientation comprises one of approximately zero degrees and approximately ninety degrees with respect to the axis.

33. The apparatus of claim 11 wherein the predetermined angle is based upon the angle of the fabric with respect to the axis.

34. The apparatus of claim 11 wherein the predetermined angle is based upon a woven pattern of the fibers in the pre-woven fabric.

35. The apparatus of claim 11 wherein the predetermined angle comprises one of approximately zero degrees and approximately ninety degrees with respect to the axis.

36. The apparatus of claim 19 wherein the bonded disk stack has a rating between approximately 6 kV and approximately 800 kV.

37. The apparatus of claim 19 wherein the electrical apparatus is constructed so as to withstand at least one 100 kA impulse.

38. The apparatus of claim 19 wherein the fibers in the fiber matrix are oriented in a predetermined orientation with respect to an axis of the electrical element.

39. The apparatus of claim 38 wherein the predetermined orientation is based upon the orientation of the fabric with respect to the axis.

40. The apparatus of claim 38 wherein the predetermined orientation is based upon a woven pattern of the fibers in the pre-woven fabric.

41. The apparatus of claim 38 wherein the predetermined orientation comprises one of approximately zero degrees and approximately ninety degrees with respect to the axis.

42. The apparatus of claim 38 wherein the fibers in the fiber matrix are oriented parallel to the axis.

43. The apparatus of claim 19 wherein the fibers in the fiber matrix are of a uniform length.

44. The apparatus of claim 19 wherein the fibers in the fiber matrix are of a non-uniform length.

45. The apparatus of claim 19 wherein the fibers in the fiber matrix comprise fiberglass.

46. The apparatus of claim 19 wherein the fibers in the fiber matrix comprise a non-conductive material.

47. The apparatus of claim 19 wherein the fiber matrix is applied circumferentially.

48. The apparatus of claim 47 wherein the fiber matrix is applied circumferentially such that the fibers have a predetermined orientation at a predetermined angle with respect to an axis of the electrical element.

49. The apparatus of claim 48 wherein the predetermined angle is based upon the angle of the fabric with respect to the axis.

50. The apparatus of claim 48 wherein the predetermined angle is based upon a woven pattern of the fibers in the pre-woven fabric.

51. The apparatus of claim 48 wherein the predetermined angle comprises one of approximately zero degrees and approximately ninety degrees with respect to the axis.

52. The apparatus of claim 48 wherein the predetermined angle is an angle less than approximately 50 degrees.

53. The apparatus of claim 52 wherein the angle is between approximately 3 degrees and approximately 10 degrees.

54. The apparatus of claim 47 wherein the circumferentially applied fiber matrix has a predetermined thickness.

55. The apparatus of claim 19 wherein the fiber matrix is applied vertically.

56. The apparatus of claim 55 wherein the vertical application comprises at least one piece of fiber matrix placed in a vertical orientation along an axis of the electrical element.

57. The apparatus of claim 55 wherein the vertical application comprises a single piece of fiber matrix placed in a vertical orientation along an axis of the electrical element and having a sufficient width to cover the majority of an outer surface of the electrical element.

58. The apparatus of claim 19 wherein the reinforcing structure further comprises at least one layer of pre-impregnated fiber matrix applied circumferentially and at least one layer of pre-impregnated fiber matrix applied vertically.

59. The apparatus of claim 19 wherein the reinforcing structure has a uniform thickness.

60. The apparatus of claim 19 wherein the reinforcing structure is configured to reinforce a selected portion of an area of the bonded disk stack along a lengthwise axis of the bonded disk stack.

61. The apparatus of claim 60 wherein the selected portion of the area comprises less than all of the area.

62. The apparatus of claim 60 wherein the selected portion of the area comprises an area excluding the ends of the bonded disk stack.

63. The apparatus of claim 60 wherein the selected portion of the area comprises an area including a center of the bonded disk stack.

64. An electrical apparatus comprising:

an electrical element comprising a bonded disk stack having an outer surface, the bonded disk stack comprising two or more MOV disks, each disk having a face-to-face bond with each adjacent disk, the bonded disk stack having a rating of at least 6 kV; and wherein the bond between adjacent MOV disks has a first Young's modulus and each MOV disc has a second Young's modulus that is at least twice as great as the first Young's modulus.

65. The apparatus of claim 64 wherein the fibers are oriented in an arbitrary orientation.

66. The apparatus of claim 1 wherein the monolithic MOV disk has a rating greater than 6 kV.

67. The apparatus of claim 66 wherein the monolithic MOV has a rating of 9 kV.

68. The apparatus of claim 19 wherein the bonded disk stack has a rating greater than 6 kV.

69. The apparatus of claim 68 wherein the bonded disk stack has a rating of 9 kV.

70. The apparatus of claim 64 wherein the bonded disk stack has a rating greater than 6 kV.

71. The apparatus of claim 70 wherein the bonded disk stack has a rating of 9 kV.

72. The apparatus of claim 64, wherein the second Young's modulus is at least ten times greater than the first Young's modulus.

* * * * *